US005575244A

United States Patent [19]

Dethier

[11] Patent Number: 5,575,244

[45] Date of Patent: Nov. 19, 1996

[54] HEAT RECOVERY BOILER WITH INDUCED CIRCULATION

[75] Inventor: Alfred Dethier, Lince-Sprimont, Belgium

[73] Assignee: Cockerill Mechanical Industries S.A., Seraing, Belgium

[21] Appl. No.: 325,442

[22] PCT Filed: Apr. 30, 1993

[86] PCT No.: PCT/BE93/00092

§ 371 Date: Dec. 28, 1994

§ 102(e) Date: Dec. 28, 1994

[87] PCT Pub. No.: WO93/23702

PCT Pub. Date: Nov. 25, 1993

[30] Foreign Application Priority Data

May 8, 1992 [BE] Belgium ..... 9200428

[51] Int. Cl.[6] ..... F22D 7/00

[52] U.S. Cl. ..... 122/406.1; 122/488; 122/489; 122/491; 122/448.1

[58] Field of Search ..... 122/406.1, 488, 122/489, 491, 448.1

[56] References Cited

U.S. PATENT DOCUMENTS

| | | | |
|---|---|---|---|
| 2,031,423 | 2/1936 | Keenan, Jr. | 122/355 |
| 2,257,358 | 8/1939 | Wightman | 122/448 |
| 2,702,026 | 2/1955 | Dalin . | |
| 4,151,813 | 5/1979 | Gorzegno et al. | 122/407 |
| 4,531,479 | 7/1985 | Gilbert | 122/504.2 |

FOREIGN PATENT DOCUMENTS

| | | |
|---|---|---|
| 0357590 | 3/1990 | European Pat. Off. . |
| 279427 | 4/1914 | Germany . |
| 308694 | 7/1917 | Germany . |

*Primary Examiner*—Henry A. Bennett
*Assistant Examiner*—Siddmarth Ohri
*Attorney, Agent, or Firm*—Jacobson, Price, Holman & Stern, PLLC

[57] ABSTRACT

The invention relates to a boiler (1) wherein at least one steam generating circuit comprises an ejector (25) capable of providing induced circulation of water in the boiler in normal operating conditions. The corresponding water/steam separation reservoir (17) is arranged at any height with respect to the outlet collector (manifold) (15) of the evaporator device (11) of said circuit.

34 Claims, 3 Drawing Sheets

HEAT RECOVERY BOILER WITH INDUCED CIRCULATION

SUBJECT OF THE INVENTION

The invention relates to a heat recovery boiler in which the water circulation is ensured without resorting to a thermal siphon effect.

It also relates to a process for the optimum use of such a boiler, for example in an electrical power station.

TECHNOLOGICAL BACKGROUND

Heat recovery boilers necessarily comprise means for ensuring the circulation of fluids.

They find an industrial application in so-called combined-cycle electrical power stations and in so-called cogeneration plants for producing electricity and steam simultaneously.

They can be employed in other conventional applications.

Such boilers are used to recover the large quantity of heat contained in the exhaust gas stream of a gas turbine and to convert water into steam. The latter is then itself employed in a steam turbine which drives an alternator.

STATE OF THE ART

Boilers are fed with water by means of a feed pump. They comprise one or more steam generating circuits, each including an evaporator device and a water/steam separating flask. These are mutually connected by conduits in which water circulates at the beginning and then a water/steam mixture. A number of steam generating circuits can be installed in a boiler in order to supply steam at different pressures and thus to improve the overall efficiency of the plant.

Heat exchanges between the gases originating from the gas turbine and initially water and then subsequently the water/steam mixture circulating in the boiler take place at the evaporator device. The latter consists of circuits of finned pipes fitted, depending on the case, vertically or horizontally, and installed in a stream of hot gases originating, for example, from a gas turbine. Conventionally, when it is running, each evaporator device is fed with water from the corresponding water/steam separating flask via a so-called entry manifold, to which are welded the entries of the pipes constituting this evaporator device and a so-called exit manifold which collects the water/steam mixture obtained. This exit manifold is connected to the same separating flask, thus creating a closed circuit.

The number of pipe circuits mutually connecting the so-called entry and exit manifolds depends on the size and the operating conditions of the boiler.

The pressure drop in the water between the entry and exit manifolds of the evaporator device is particularly a function of the configuration of the conduits. According to different alternative forms, the pipes of the evaporator device can be arranged either vertically or horizontally.

Essentially two types of boilers are distinguished as a function of the type of water circulation in the circuits.

The circulation is said to be "natural" or by a thermal siphon effect, when the water circulates in the boiler by virtue of the density difference of the water when it changes from the liquid phase to the vapor phase. Natural-circulation boilers are described, for example, in patents U.S. Pat. No. 2,031,423 and U.S. Pat. No. 2,702,026.

U.S. Pat. No. 2,257,358 describes a steam generator device with circulation using thermal siphon in which a device referred to as an ejector, consisting of two coaxial conduits and not described otherwise is fitted at the exit of a water/steam separating flask to accelerate the thermal siphon effect.

The device described includes two independent circuits in which the water to be heated circulates in horizontal pipes from the bottom upwards while the combustion gases circulate from the top downwards, said separating flask being fitted above the boiler.

As indicated, a circulation using thermal siphon is produced under the combined effect of a "natural" and artificially accelerated circulation.

It should be noted that the device referred to as an ejector is relatively unrefined and not controllable. Moreover, it is fitted in the bringing (downward) line of one of the circuits originating from the separator flask.

Patent application EP-A-0357590 describes a boiler with horizontal pipes, operating on the basis of a natural water circulation, without application of a circulation pump, by virtue of the thermal siphon effect.

The water circulates loopwise between the flask and the evaporator device in the various conduits. It travels down from the flask in an unheated leg and moves back up thereto in a heated leg, where it is in the form of a water/steam mixture, the evaporator device being inserted into the "rising" leg.

In normal operation the force driving circulation reaches at most a value determined by the difference in height between the flask and the exit manifold of the evaporator device.

Thus, to obtain a sufficient driving force, for example of 1 kg/cm$^2$, between the manifolds, a water column approximately 10m in height must be available above the exit manifold, and this demands a considerable bulk.

In addition, the value of the pressure drop in normal operation is not predetermined in order that it should conform to the thermal stability and flow requirements in the boiler, which demand a minimum circulation rate, depending on the desired pressures. This circulation rate depends on the value of the driving force and on that of the pressure drop in a given circuit.

As the driving force obtained by natural circulation is weak, it is necessary to arrange a large number of pipe circuits in parallel in the evaporator device to decrease the pressure drop. The structure of the manifolds is therefore proportionally complicated thereby. The diameter of the pipes must also be greater, also in order to reduce the pressure drop.

The circulation rate of a boiler is the average number of times a drop of water must go around the evaporation circuit before being completely vaporized and thus leaving the circuit. This rate remains limited in natural-circulation boilers in view of the weak driving forces involved. Moreover, as the flow rate may be too low in some pipe circuits, this may result in a loss in overall performance and in high risks of corrosion of these pipes due to precipitation on the inner wall of all the salts present in the water, following the total evaporation of the small quantity of water contained in this circuit.

A water circulation starting-up stage is necessary and can be carried out in various ways, for example by the action of an ejector optionally coupled to an additional pump, and fitted in a bypass line, and which would be employed solely for starting-up by gas injection into the riser pipes or by connecting the entry and exit manifolds of the evaporator device.

Boilers of the type described are relatively bulky and their performance depends to a large extent on their configuration.

A circulation is said to be forced or else assisted when the water circulation in the boiler is created by one or more so-called circulation pumps arranged between the flask and the manifolds. The pipes of the evaporator device are then usually arranged horizontally.

The circulation pumps consume energy and require maintenance costs which are sometimes considerable.

OBJECTIVES OF THE INVENTION

An essential objective of the invention is to combine the advantages of the boilers with natural circulation and with forced circulation, while not exhibiting their disadvantages.

The invention has the objective of providing compact heat recovery boilers, that is to say with a height of water in the rising leg above the exit manifold which may be of no importance.

Another of its objectives is to provide boilers which make it unnecessary to use a circulation pump for circulating water in the pipe circuits constituting the evaporator device.

It has a further objective of providing such boilers in which the pressure drop of the water between the entry manifold and the exit manifold of the evaporator device may be chosen at a value which is predetermined as a function of the stability criteria which are desirable for the boiler. In particular, it has the objective that, in such boilers, the pressure drop should not be determined solely by the height of a column of water in the rising leg of the boiler.

An additional objective of the invention is to provide such boilers in which the circulation is ensured by an economic device which is more reliable because it is less complex and which demands little in the way of maintenance costs.

A final objective of the invention is to make it possible to limit the number of evaporator circuits and to select pipes of small diameter which are less sensitive to heat stresses, and to obtain a simpler construction of the manifolds, which comprise fewer pipe connections and which can also be smaller, and a smaller volume of water in the evaporator, and hence an improved dynamic behavior and reduced time constants.

ESSENTIAL FEATURES OF THE INVENTION

The subject of the invention is a heat recovery boiler comprising one or more steam generating circuits, optionally at different pressures, each comprising

- a water/steam separating flask,
- an evaporator device with finned pipes, arranged horizontally in a stream of hot gases,
- downcomer and riser pipes ensuring the communication between the flask and the evaporator device via an entry manifold and an exit manifold.

In the boiler of the invention at least one steam generating circuit comprises an adjustable ejector capable of limiting the flow rate of the driving fluid during the starting up stage and of ensuring an induced water circulation in the boiler in normal operation, it being then possible for the corresponding water/steam separating flask to be arranged at any height in relation to the exit manifold of the evaporator device of this cicuit.

By virtue of the ejector, the induced water circulation can be maintained in a uniform manner.

In case of a plurality of steam generating circuits, each steam generating circuit preferably comprises an ejector capable of ensuring the induced water circulation in the boiler in normal operation.

In such a case the boiler can then be devoid of any circulation pump.

The ejector is preferably placed in a feed line.

Each steam generating circuit comprising an ejector can be equipped with a means for ensuring a minimum flow rate of this ejector during the boiler starting-up stage.

This may be an auxiliary startup pump provided in a line fitted as a bypass between a point in the downcomer pipe and a point in the feed line situated upstream of the ejector.

Alternatively, the flask of the steam generating circuit in question may be equipped, in its water zone, with a device capable of allowing it to be drained during the starting-up stage.

It is self-evident that the two solutions may coexist in the same single steam generating circuit.

Each ejector is advantageously equipped with a movable needle at its conical nozzle. This needle enables the characteristics of the ejector to be adjusted.

According to a preferred embodiment the difference in height between the flask of a steam generating circuit and the exit manifold of the corresponding evaporator device is nil.

Advantageously, according to the invention, the flask of a circuit can be arranged at a height lower than that of the exit manifold of the corresponding evaporator device.

Another subject of the invention is a process for employing a boiler as described above, in which the following stages are performed:

- water is introduced into the evaporator device and the flask of at least one steam generating circuit, by means of a feed pump, this being done up to a so-called starting-up level;
- a means is actuated for ensuring a minimum flow rate permitting the operation of the ejector during the starting-up stage;
- the boiler is heated;
- the feed pump is again set in motion so as to allow the ejector to ensure the induced circulation during the normal operation of the boiler.

During the starting-up stage a movable needle is preferably introduced into a part of the ejector and is actuated in order to control the flow rate of the water as a function of the requirements.

BRIEF DESCRIPTION OF THE FIGURES

The invention will be better understood with reference to the attached drawings, in which.

DETAILED DESCRIPTION OF THE FIGURES

Figure 1:
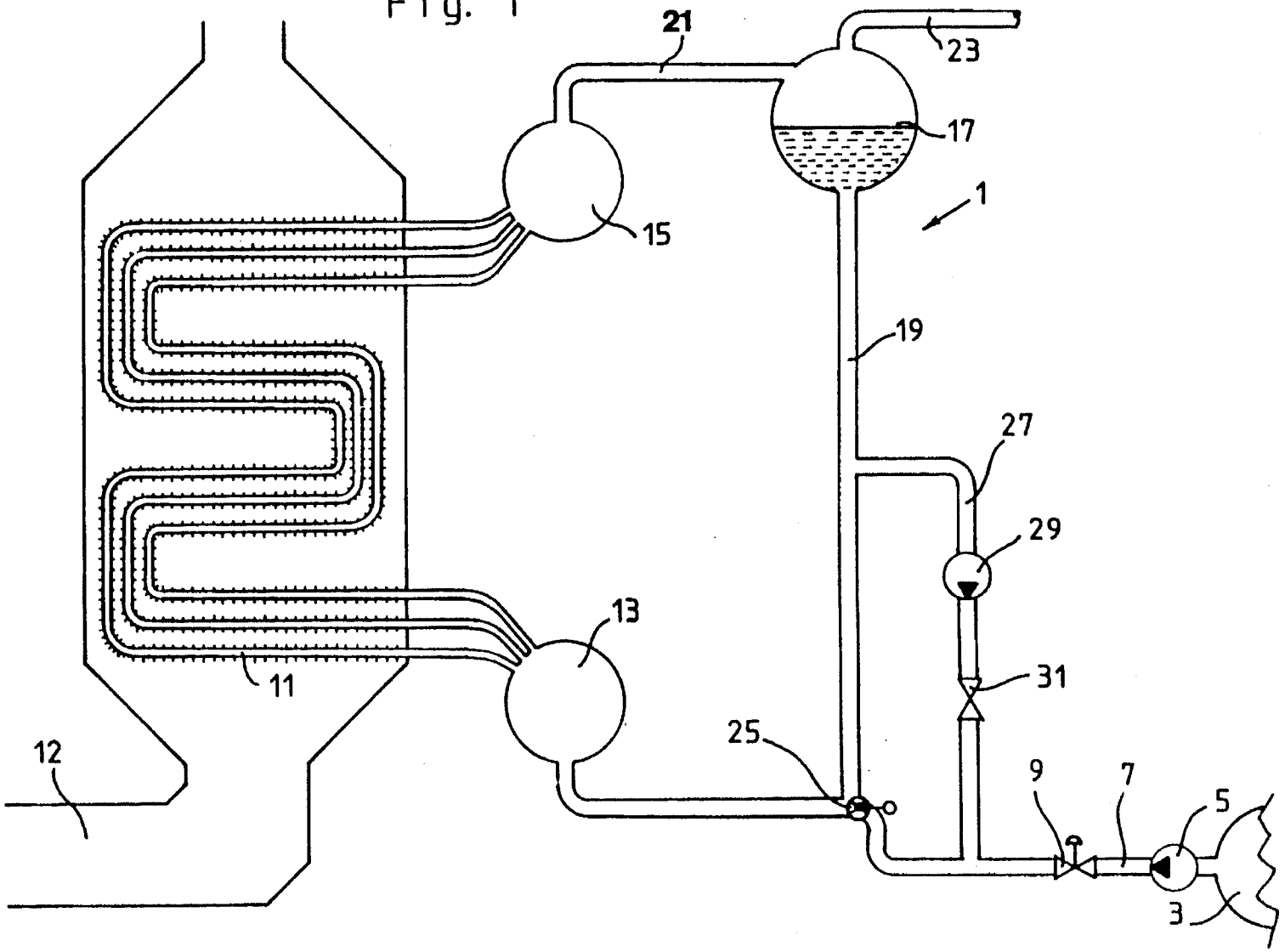
FIG. 1 is a diagrammatic view of a first embodiment of a boiler with induced circulation according to the invention.

FIG. 1 shows a diagrammatic view of a boiler 1 according to the invention, arranged between a gas turbine and a steam turbine, which are not shown, as, for example, in an electrical power station.

The continuation of the description will refer to a boiler employed in such an application, but it should be understood that it will not constitute a departure from the scope of the invention to apply it to conventional boilers.

The boiler 1 is fed by virtue of a storage vessel 3 and a feed pump 5. The feed line 7 is equipped with a control valve 9 which can be actuated according to the water requirements of the boiler 1. An evaporator device 11 consisting of finned pipes arranged horizontally in an exhaust channel for hot gases 12 is conventionally provided. Three circuits of finned pipes in parallel have been shown in FIG. 1 but, in practice, by virtue of the invention there may be a limit of 200 to 300 circuits, which is a small number in comparison with the natural circulation boilers of the state of the art, which usually comprise approximately 800 circuits.

This evaporator device 11 conventionally comprises an entry manifold 13 and an exit manifold 15. Both are connected to a water/steam separating flask 17. The entry manifold 13 is connected to the water zone of said flask 17 via a so-called downcomer pipe 19, whereas the exit manifold 15 is connected to the steam zone of the flask 17 by a so-called riser pipe 21. A conduit 23 for taking away the steam from the flask 17 is provided in the upper part of the steam zone.

An ejector 25 is placed at the intersection of the feed line 7 and of the downcomer pipe 19. Before the boiler is started up, water is introduced into the evaporator device 11 and into the flask 17 by means of the feed pump 5, up to a so-called starting-up level. When the water level in the flask 17 reaches a few tens of centimeters the control valve 9 is closed. The feed water is then employed as driving fluid; it passes through the ejector 25 with a certain pressure drop while increasing its speed, and this induces a suction of water in the downcomer pipe 19 and hence the circulating motion of the water. For this reason, this is referred to as induced circulation in the boiler.

The mixture of feed water/water originating from the flask is delivered towards the entry manifold 13 at a determined overpressure. The ejector continues to operate permanently when the boiler is running normally, that is to say from the time when the flow rate of the driving fluid which enters it reaches a certain value.

During the starting-up period the feed water flow rate will be nil. However, an ejector can operate only if it has a minimum flow rate available to it.

The closure of the control valve 9 is necessary, in principle, to ensure a correct starting-up: before the boiler is in operation there is no water consumption. It is therefore appropriate to avoid overfilling the flask 17, to prevent water flowing towards the steam discharge conduit 23, which would be unacceptable.

However, a water circulation at the starting-up must be ensured in the evaporator device/flask circuit, this being in order to heat the group of units uniformly.

Depending on the site conditions, this circulation can be obtained in various ways.

A first possibility is illustrated in FIG. 1. A bypass line 27 can be provided on the downcomer pipe 19, ending in the feed line 7 upstream of the ejector 25. An auxiliary startup pump 29 and an auxiliary valve 31 are then provided in this line 27; this latter valve is opened when the valve 9 is closed. The pump 29 temporarily ensures the circulation of the driving fluid starting with the water originating from the flask 17. This pump 29 may be of small capacity.

Figure 2:
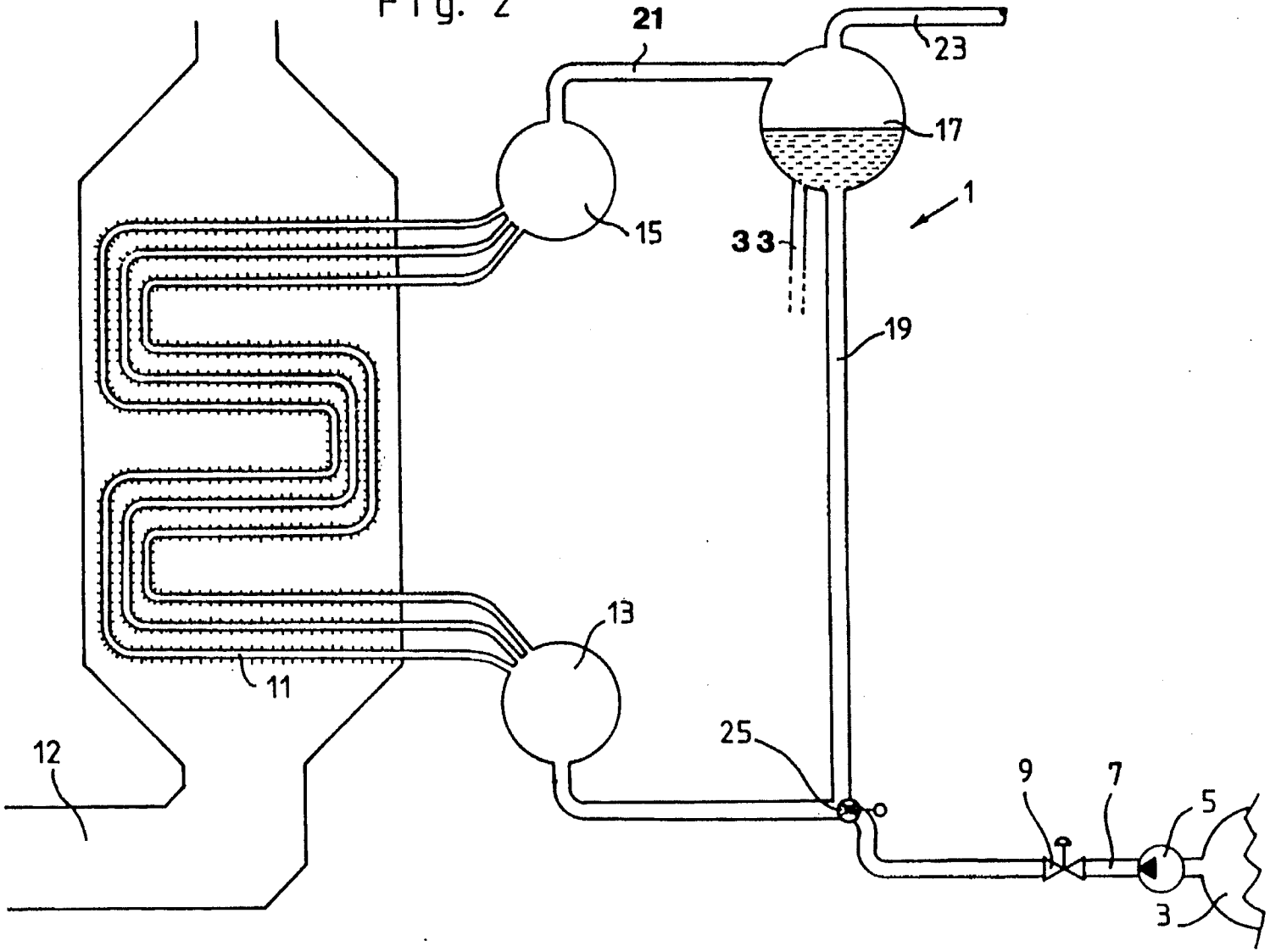
FIG. 2 is a diagrammatic view of a second embodiment of a boiler with induced circulation according to the invention.

Alternatively, as shown in FIG. 2, a pipeline 33 may be provided for draining the flask 17 with a possible recycling of the water towards the storage vessel 3 or towards a condenser, not shown, or a pure and simple discharge of the water.

The fall in the water level in the flask 17 will induce a water demand which will force the control valve 9 to open and the feed pump 5 to ensure a driving flow, and this will enable the ejector 25 to start operating normally. In this case the valve 9 therefore remains open even on starting up, and feed water may be allowed to enter the boiler without risking flooding the latter.

When the starting-up circulation has been established, the boiler 1 may be heated, either by starting up the gas turbine or by operating the fume dampers (not shown), depending on the plant.

The first steam bubbles will be rapidly formed in the bottom part of the evaporator device 11, driving the water back towards the flask 17 through the riser pipe 21. The water level in the flask will therefore rise. It will then progressively decrease as a function of the steam produced and conveyed towards the user. When the level has returned to a normal value, feed water will have to be introduced into the boiler 1 in quantities equal to the steam produced; the control valve 9 is fully opened and the ejector 25 then works in a normal regime. The starting-up circuit can then be cut off.

It should be noted that each variation in the temperature or the flow rate of the hot gases entering the boiler corresponds to a variation in the flow rate of steam and therefore an identical variation in the flow rate of feed water, controlled by the control valve 9.

Figure 3:
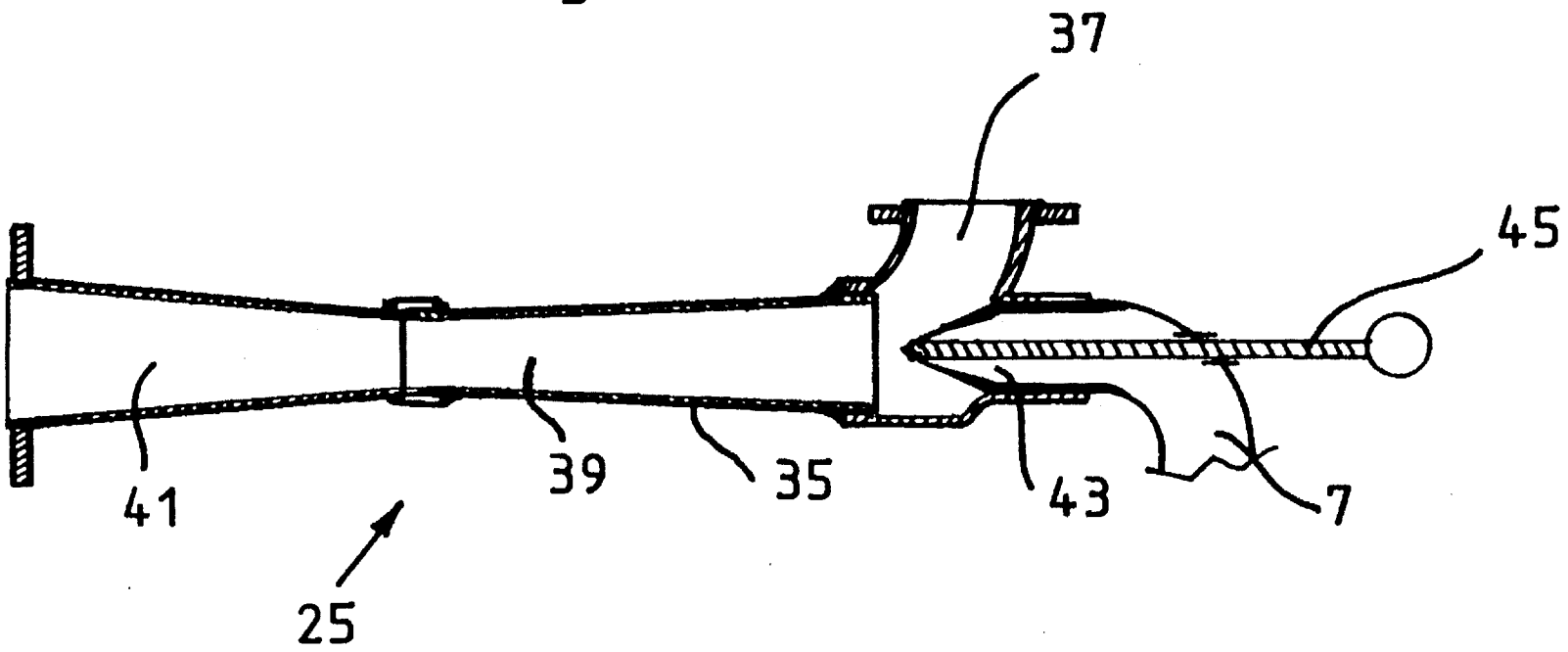
FIG. 3 is a sectional view of an ejector equipped with a needle which can be employed in a boiler according to the invention.

FIG. 3 is a detailed view of an improved ejector 25 according to the invention. It conventionally comprises a body 35, a suction flange 37, a mixing zone 39, a diffuser 41 and a conical nozzle 43. The latter is advantageously provided with a movable needle 45. During the starting-up stage the needle 45 is introduced inside the conical nozzle 43, and this makes it possible to limit the flow rate of driving fluid while maintaining the induced flow capacities of the ejector 25.

In normal operation of the boiler 1 the needle 45 is withdrawn from the nozzle 43 and the ejector 25 operates according to its initial characteristics.

In the boilers of the invention it is possible to employ either a standard ejector or an improved ejector like that shown in FIG. 3.

A concrete example of embodiment of a boiler according to the invention is described below (but not illustrated in the figures).

Typically, a current combined-cycle electrical power station comprises one or two gas turbines of 100 and 500 MW, each equipped with a heat recovery boiler with two pressure levels, producing high pressure steam (approximately 80 to 100 kg/cm$^2$) and low pressure steam (approximately 8 to 10 kg/cm$^2$), feeding a steam turbine with two pressure levels, with a power of 100 to 150 MW.

Each boiler comprises two steam generating circuits, each equipped with three heat exchangers, namely an evaporator, an economizer and a superheater, and with a water/steam separating flask.

The two steam generating circuits are independent and each of them can operate with induced circulation according to the invention.

However, it will not constitute a departure from the scope of the invention if, while one given steam generating circuit of a boiler comprises an ejector which ensures the induced circulation of the driving fluid, another circuit of the same boiler operates according to another type of circulation, for example with forced circulation by means of a circulation pump.

In the example given, in the case of each steam generating circuit operating with induced circulation, the pressure drop in the evaporator device will be chosen as a function of the flow and heat exchange stabilities, that is 3 to 5 kg/cm$^2$. The finned pipes will then be small in diameter (approximately 32 to 38 mm). The volume of water in the evaporator device will also be capable of being relatively small (approximately 10 to 15m$^3$). This capacity will be sufficient to accept the transfer of water from the evaporator device during starting-ups.

It will be possible for the sheet metal of which the flask consists to be of reduced thickness (approximately 30 to 50 mm), permitting high temperature and/or pressure gradients. In this way, the starting-up period of the boiler can be very short and capable of being adapted to the very short starting-up periods of the gas turbines.

The dynamic behavior of the boiler is markedly improved, with reduced time constants. In addition, the circulation rate can be chosen with a high safety margin.

I claim:

1. Heat recovery boiler comprising one or more steam generating circuits, optionally at different pressures, each comprising a water/steam separating flask, an evaporator device with finned pipes, arranged horizontally in a stream of hot gases, downcomer and riser pipes ensuring the communication between the flask and the evaporator device via an entry manifold and an exit manifold, at least one steam generating circuit comprises an ejector capable of ensuring an induced water circulation in the boiler in normal operation, and in that the corresponding water/steam separating flask is arranged at any height in relation to the exit manifold of the evaporator device of this circuit, and each steam generating circuit comprising an ejector additionally comprises a means for ensuring a minimum flow rate permitting the operation of this ejector during the stage of starting up the boiler.

2. Boiler according to claim 1, wherein each steam generating circuit comprises an ejector capable of ensuring the induced water circulation in the boiler in normal operation.

3. Boiler according to claim 2, wherein the boiler is devoid of any circulation pump.

4. Boiler according to claim 1, wherein the ejector is placed in a feed line.

5. Boiler according to claim 1, wherein an auxiliary start-up pump is provided in a line fitted as a bypass between a point in the downcomer pipe and a point in the feed line situated upstream of the ejector.

6. Boiler according to claim 1, wherein the flask of said steam generating circuit is equipped in its water zone with a device capable of allowing this flask to be drained during the starting-up stage.

7. Boiler according to claim 1, wherein each ejector is equipped with a movable needle at its conical nozzle.

8. Boiler according to claim 1, wherein the difference in height between the flask of a steam generating circuit and the exit manifold of the corresponding evaporator device is nil.

9. Boiler according to claim 1 wherein the flask of a steam generating circuit is arranged at a height lower than that of the exit manifold.

10. Process for employing a boiler comprising one or more steam generating circuits, optionally at different pressures, each comprising a water/steam separating flask, an evaporator device with finned pipes, arranged horizontally in a stream of hot gases, downcomer and riser pipes ensuring the communication between the flask and the evaporator device via an entry manifold and an exit manifold, at least one steam generating circuit comprises an ejector capable of ensuring an induced water circulation in the boiler in normal operation, and in that the corresponding water/steam separating flask is arranged at any height in relation to the exit manifold of the evaporator device of this circuit, said process comprising the following stages:

introducing water into the evaporator device and the flask of at least one steam generating circuit, by means of a feed pump, this being done up to a starting-up level;

actuating a means for ensuring a minimum flow rate permitting the operation of the ejector during the starting-up stage;

heating the boiler;

setting the feed pump in motion again so as to allow the ejector to ensure the induced circulation during the normal operation of the boiler; and introducing a movable needle during the starting-up stage into a part of the ejector and in that it is actuated to control the flow rate of the water.

11. Heat recover boiler comprising one or more steam generating circuits, optionally at different pressures, each comprising a water/steam separating flask, an evaporator device with finned pipes, arranged horizontally in a stream of hot gases, downcomer and riser pipes ensuring the communication between the flask and the evaporator device via an entry manifold and an exit manifold, at least one steam generating circuit comprises an ejector capable of ensuring an induced water circulation in the boiler in normal operation, and in that the corresponding water/steam separating flask is arranged at any height in relation to the exit manifold of the evaporator device of this circuit, and each ejector being equipped with a movable needle at its conical nozzle.

12. Boiler according to claim 11, wherein each steam generating circuit comprises an ejector capable of ensuring the induced water circulation in the boiler in normal operation.

13. Boiler according to claim 12, wherein the boiler is devoid of any circulation pump.

14. Boiler according to claim 11, wherein the ejector is placed in a feed line.

15. Boiler according to claim 11, wherein the difference in height between the flask of a steam generating circuit and the exit manifold of the corresponding evaporator device is nil.

16. Boiler according to claim 11, wherein the flask of a steam generating circuit is arranged at a height lower than that of the exit manifold.

17. Heat recovery boiler comprising one or more steam generating circuits, optionally at different pressures, each comprising a water/steam separating flask, an evaporator device with finned pipes, arranged horizontally in a stream of hot gases, downcomer and riser pipes ensuring the communication between the flask and the evaporator device via an entry manifold and an exit manifold, at least one steam generating circuit comprises an adjustable ejector capable of limiting the flow rate of the driving fluid during the starting-up stage and of ensuring an induced water circulation in the boiler in normal operation, and each steam generating circuit comprising an ejector additionally comprises a means for ensuring a minimum flow rate permitting the operation of this ejector during the stage of starting up the boiler.

18. Boiler according to claim 17, wherein in case of a plurality of steam generating circuits, each steam generating circuit comprises an ejector capable of ensuring the induced water circulation in the boiler in normal operation.

19. Boiler according to claim 18, wherein the boiler is devoid of any circulation pump.

20. Boiler according to claim 17, wherein the ejector is placed in a feed line.

21. Boiler according to claim 17, wherein an auxiliary start-up pump is provided in a line fitted as a bypass between a point in the downcomer pipe and a point in the feed line situated upstream of the ejector.

22. Boiler according to claim 17, wherein the flask of said steam generating circuit is equipped in its water zone with a device capable of allowing this flask to be drained during the starting-up stage.

23. Boiler according to claim 17, wherein each ejector is equipped with a movable adjustment needle at its conical nozzle.

24. Boiler according to claim 17, wherein the difference in height between the flask of a steam generating circuit and the exit manifold of the corresponding evaporator device is nil.

25. Boiler according to claim 17, wherein the flask of a steam generating circuit is arranged at a height lower than that of the exit manifold.

26. Boiler according to claim 17, wherein the water/steam separating flask is arranged at any height with respect to the exit manifold of the evaporator device of the steam generating circuit.

27. Process for employing a boiler comprising one or more steam generating circuits, optionally at different pressures, each comprising a water/steam separating flask, an evaporator device with finned pipes, arranged horizontally in a stream of hot gases, downcomer and riser pipes ensuring the communication between the flask and the evaporator device via an entry manifold and an exit manifold, at least one steam generating circuit comprises an adjustable ejector capable of limiting the flow rate of the driving fluid during the starting-up stage and of ensuring an induced water circulation in the boiler in normal operation, introducing water into the evaporator device and the flask of at least one steam generating circuit, by means of a feed pump, this being done up to a starting-up level;

actuating a means for ensuring a minimum flow rate permitting the operation of the ejector during the starting-up stage with minimum adjustment;

heating the boiler;

setting the feed pump in motion again so as to allow the ejector to ensure the induced circulation during the normal operation of boiler; and introducing a movable needle during the starting-up stage into a part of the ejector including a conical nozzle and in that it is actuated to control the flow rate of the water.

28. Heat recovery boiler comprising one or more steam generating circuits, optionally at different pressures, each comprising a water/steam separating flask, an evaporator device with finned pipes, arranged horizontally in a stream of hot gases, downcomer and riser pipes ensuring communication between the flask and the evaporator device via an entry manifold and an exit manifold, at least one steam generating circuit comprises an adjustable ejector capable of limiting the flow rate of the driving fluid during the starting-up stage and of ensuring an induced water circulation in the boiler in normal operation, and each ejector being equipped with a movable adjustment needle at its conical nozzle.

29. Boiler according to claim 28, wherein in case of a plurality of steam generating circuits, each steam generating circuit comprises an ejector capable of ensuring the induced water circulation in the boiler in normal operation.

30. Boiler according to claim 29, wherein the boiler is devoid of any circulation pump.

31. Boiler according to claim 28, wherein the ejector is placed in a feed line.

32. Boiler according to claim 28, wherein the difference in height between the flask of a steam generating circuit and the exit manifold of the corresponding evaporator device is nil.

33. Boiler according to claim 28, wherein the flask of a steam generating circuit is arranged at a height lower than that of the exit manifold.

34. Boiler according to claim 28, wherein the water/steam separating flask is arranged at any height with respect to the exit manifold of the evaporator device of the steam generating circuit.

* * * * *